US009257734B2

(12) United States Patent
Hoover

(10) Patent No.: US 9,257,734 B2
(45) Date of Patent: Feb. 9, 2016

(54) COMPACT AMPLITUDE AND PHASE TRIMMER

(71) Applicant: Honeywell International Inc., Morristown, NJ (US)

(72) Inventor: John C. Hoover, Fernandina Beach, FL (US)

(73) Assignee: Honeywell International Inc., Morris Plains, NJ (US)

( * ) Notice: Subject to any disclaimer, the term of this patent is extended or adjusted under 35 U.S.C. 154(b) by 109 days.

(21) Appl. No.: 14/139,392

(22) Filed: Dec. 23, 2013

(65) Prior Publication Data

US 2015/0180102 A1 Jun. 25, 2015

(51) Int. Cl.

| | |
|---|---|
| ***H01P 1/16*** | (2006.01) |
| ***H01P 1/22*** | (2006.01) |
| ***H01P 1/18*** | (2006.01) |
| ***H01P 1/165*** | (2006.01) |
| ***H01P 1/06*** | (2006.01) |
| ***H01P 1/162*** | (2006.01) |
| ***H01P 1/17*** | (2006.01) |
| ***H01P 5/04*** | (2006.01) |

(52) U.S. Cl.

CPC ..... *H01P 1/182* (2013.01); *H01P 1/066* (2013.01); *H01P 1/162* (2013.01); *H01P 1/165* (2013.01); *H01P 1/173* (2013.01); *H01P 1/222* (2013.01); *H01P 5/04* (2013.01)

(58) Field of Classification Search

CPC ..... H01P 1/165; H01P 1/182; H01P 1/222; H01P 1/06; H01P 1/066

USPC ..... 333/21 R

See application file for complete search history.

(56) References Cited

U.S. PATENT DOCUMENTS

| | | | | |
|---|---|---|---|---|
| 2,433,011 | A | | 12/1947 | Zaleski |
| 2,438,119 | A | | 3/1948 | Fox |
| 2,531,194 | A | * | 11/1950 | Bowen ..... 333/81 B |
| 2,546,840 | A | | 3/1951 | Tyrrell |
| 2,603,710 | A | | 7/1952 | Bowen |
| 3,588,751 | A | | 6/1971 | Kolbly |
| 3,621,481 | A | | 11/1971 | Perreault et al. |
| 4,564,824 | A | | 1/1986 | Boyd, Jr. |

(Continued)

OTHER PUBLICATIONS

Fox, A.G., "An Adjustable Wave-Guide Phase Changer," Proceedings of the I.R.E., vol. 35, Issue 12, Dec. 1947, pp. 1489-1498.

(Continued)

*Primary Examiner* — Stephen E Jones
*Assistant Examiner* — Scott S Outten
(74) *Attorney, Agent, or Firm* — Fogg & Powers LLC

(57) ABSTRACT

In some examples, a device includes a waveguide transition section comprising a first mode suppressor, an attenuation section coupled to the first waveguide transition section via a first adjustable rotation joint, wherein the attenuation section is operable to attenuate the electromagnetic signal, and a first quarter-wave plate section coupled to the attenuation section, wherein the first quarter-wave plate section is operable to introduce a first differential phase shift between a first mode of the electromagnetic signal and a second mode of the electromagnetic signal. The device also includes a second quarter-wave plate section coupled to the first quarter-wave plate section via a second adjustable rotation joint, wherein the second quarter-wave plate section is operable to introduce a second differential phase shift between the second mode of the electromagnetic signal and the first mode of the electromagnetic signal.

20 Claims, 9 Drawing Sheets

(56) References Cited

U.S. PATENT DOCUMENTS

| | | | | |
|---|---|---|---|---|
| 4,891,614 | A * | 1/1990 | De Ronde | 333/122 |
| 5,191,338 | A | 3/1993 | Katz et al. | |
| 5,576,668 | A | 11/1996 | Clark et al. | |
| 5,886,671 | A * | 3/1999 | Riemer et al. | 343/776 |
| 2003/0227344 | A1 * | 12/2003 | Kovac et al. | 333/21 A |
| 2008/0186113 | A1 * | 8/2008 | Hoover | 333/249 |
| 2009/0128257 | A1 * | 5/2009 | Shinohara et al. | 333/158 |

OTHER PUBLICATIONS

European Patent Office, "Extended European Search Report from EP Application No. 14196599.6 mailed Jun. 3, 2015", "from Foreign Counterpart of U.S. Appl. No. 14/139,392", Jun. 3, 2015, pp. 17, Published in: EP.

* cited by examiner

COMPACT AMPLITUDE AND PHASE TRIMMER

TECHNICAL FIELD

This disclosure relates to conduction and modification of electromagnetic waves.

BACKGROUND

Various applications, including communications systems, navigation systems, observation platforms, and other applications may use electromagnetic radiation. Electromagnetic radiation is a form of energy emitted and absorbed by charged particles which exhibits wave-like behavior as it travels through space. Such electromagnetic signals may have various properties, such as a wavelength, a frequency, an amplitude, a phase, a polarization, or other properties. Properties of electromagnetic signals can affect the way in which the signals interact with their environment or with other electromagnetic signals. For instance, two signals having the same frequency and amplitude but having opposite phases may, in some examples, negate one another or cancel each other out.

Certain properties of electromagnetic signals, such as microwave signals or radio signals, can be changed or modified to fit a given application or implementation requirement. For instance, changing the amplitude of a signal may change the distance which the signal can travel through space. As another example, changing the phase of the signal may enable the signal to be combined in various ways with other signals.

SUMMARY

Aspects of the present disclosure may provide a compact amplitude and phase trimmer device that can provide independent amplitude and phase adjustment of an electromagnetic signal, such as a microwave signal or other signals. The compact amplitude and phase trimmer device may be beneficial in various applications, such as paralleling of amplifier signals, testing applications, or other applications including space, air, and ground applications. In this way, aspects of the present disclosure may enable attenuation and phase adjustment using a smaller, lighter weight device that has fewer parts.

In one example a device includes a waveguide transition section comprising a first mode suppressor, and an attenuation section comprising a resistive vane attenuator, the attenuation section being coupled to the first waveguide transition section via a first adjustable rotation joint, wherein the attenuation section is operable to attenuate the electromagnetic signal. The device also includes a first quarter-wave plate section comprising a first quarter-wave plate, the first quarter-wave plate section being coupled to the attenuation section, wherein the first quarter-wave plate section is operable to introduce a first differential phase shift between a first mode of the electromagnetic signal and a second mode of the electromagnetic signal, and a second quarter-wave plate section comprising a second quarter-wave plate, the second quarter-wave plate section being coupled to the first quarter-wave plate section via a second adjustable rotation joint, wherein the second quarter-wave plate section is operable to introduce a second differential phase shift between the second mode of the electromagnetic signal and the first mode of the electromagnetic signal.

In one example a method includes receiving, at a first end of an amplitude and phase trimmer device, a first electromagnetic signal, the first end of the amplitude and phase trimmer device comprising an input section, attenuating, by an attenuation section of the amplitude and phase trimmer device, the first electromagnetic signal by an attenuation value to produce a second electromagnetic signal, wherein the attenuation section is connected to the input section by a first adjustable rotation joint, and wherein the attenuation value is dependent upon a rotation angle of the first adjustable rotation joint, and modifying, by a first phase-shifting section of the amplitude and phase trimmer device, a phase of a first mode of the second electromagnetic signal with respect to a phase of a second mode of the second electromagnetic signal to produce a third electromagnetic signal, wherein the first phase-shifting section is connected to the attenuation section. The method also includes modifying, by a second phase-shifting section of the amplitude and phase trimmer device, a phase of a first mode of the third electromagnetic signal with respect to a phase of a second mode of the third electromagnetic signal to produce a fourth electromagnetic signal, the fourth electromagnetic signal having a phase difference with respect to a phase of the second electromagnetic signal, wherein the second phase-shifting section is connected to the first phase-shifting section by a second adjustable rotation joint, and wherein the phase difference is dependent upon a rotation angle of the second adjustable rotation joint, and outputting, at a second end of the amplitude and phase trimmer device, the fourth electromagnetic signal In one example a system includes means for independently adjusting attenuation and phase of an electromagnetic signal. For example, the system may include means for transitioning the electromagnetic signal from an input rectangular waveguide to a circular waveguide, means for attenuating the electromagnetic signal, the means for attenuating being coupled to the means for transitioning via a first adjustable rotation joint, and a first polarization-conversion means for converting a polarization of the electromagnetic signal by introducing a first differential phase shift between a first mode of the electromagnetic signal, the first mode having a first orientation, and a second mode of the electromagnetic signal, the second mode having a second orientation that is orthogonal to the first orientation, wherein the first polarization-conversion means is coupled to the means for attenuating. The system may further include a second polarization-conversion means for converting the polarization of the electromagnetic signal by introducing a second differential phase shift between the second mode of the electromagnetic signal and the first mode of the electromagnetic signal, the second polarization-conversion means being coupled to the first polarization-conversion means via a second adjustable rotation joint.

The details of one or more examples are set forth in the accompanying drawings and the description below. Other features, objects, and advantages will be apparent from the description and drawings, and from the claims.

DETAILED DESCRIPTION

Figure 1:
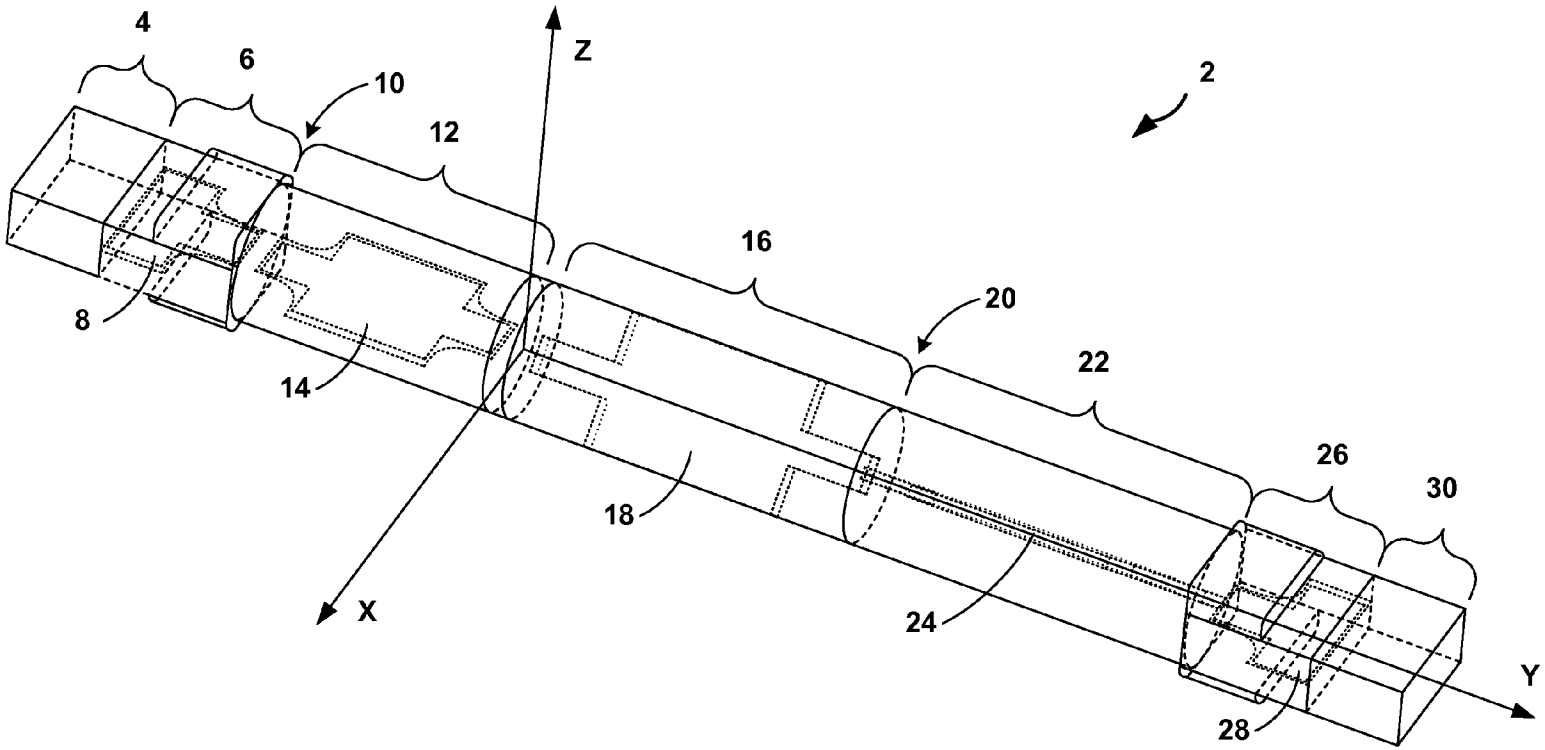
FIG. 1 is a block diagram illustrating an example amplitude and phase trimmer device, in accordance with one or more techniques of the present disclosure.

Techniques of the present disclosure provide tier a compact passive assembly that may allow for independent adjustment of the attenuation (e.g., amplitude) and the phase of an electromagnetic signal (e.g., a microwave signal). Modifying the amplitude and/or phase of an electromagnetic signal may be useful in various applications, such as when combining the output of multiple power amplifiers. That is, when combining the signals of multiple power amplifiers in parallel to generate a single output signal, independent amplitude and phase adjustment of each amplifier signal may help to achieve an increased total power output of the single output signal after combining the signal from each amplifier. In some applications, such as satellite communications and others, the size and weight of signal modification devices may be crucial. Additionally, signal properties may require independent modification. For example, it may be beneficial to modify the amplitude of an electromagnetic signal without having an effect on the phase of the signal, and/or it may be beneficial to modify the phase without affecting the amplitude.

For instance, power traveling-wave tubes (PTWAs) are typically used to generate RF power for satellite down links (e.g., in transmitting television signals for ground reception). A single PTWA may not have sufficient output power and, thus, combining the output of two or more PTWAs in parallel may be used to achieve sufficient output power. Each PTWA may have a slightly different gain and phase response. Each gain and phase response may be equalized by an amplitude and phase trimmer (e.g., at the low-power input of each PTWA) to achieve an efficient combining of output powers. This equalization may be easier and quicker if the amplitude and phase adjustments can be performed independently of one another, thereby reducing the amount of iterations required.

By utilizing techniques disclosed herein, resulting amplitude and phase adjustments for a given signal may be flat with frequency over a given bandwidth. That is, the compact amplitude and phase trimmer as disclosed herein may operate in the same manner for all frequencies in a given frequency range. Furthermore, a signal adjustment using the techniques described herein can be mathematically predicted. The attenuation of the signal may be predicted by a simple trigonometric function, and the phase change of the signal may be predicted by a relative angle of rotation.

Techniques of the present disclosure may include using a dual mode circular waveguide to allow for an output response independent of frequency and to enable attenuation and phase adjustments that are independent of one another. By combining phase control and attenuation control in a single device, the compact amplitude and phase trimmer disclosed herein may yield reduced physical insertion length, reduced mass, and/or a reduced part count while maintaining the independent attenuation and phase adjustment properties. That is, techniques of the present disclosure may provide devices that are shorter, lighter, and/or require fewer parts, while still allowing for accurate, independent signal adjustment.

By combining stand-alone amplitude and phase control devices to produce a single device, techniques of the present disclosure may significantly reduce the parts required. For instance, techniques of the present disclosure may obviate the need for more adjustable rotation joints, more mode suppressors and transitions, a single mode e-plane bend, a half-wave plate, and other components. Thus, techniques of the present disclosure may provide a device for independent amplitude and phase control that is more compact and requires fewer parts.

FIG. 1 is a block diagram illustrating an example amplitude and phase trimmer device 2, in accordance with one or more techniques of the present disclosure. Trimmer device 2 is described in the example of FIG. 1 as operating within the Ku band of microwave signals from 12.2 to 12.7 Gigahertz (GHz). For instance, trimmer device 2 of FIG. 1 may be useful at the 20 GHz frequencies for satellite down links. In other examples, trimmer device 2 may be scalable to a number of other frequency bands, such as the Ka (26.5-40 GHz) or U (40-60 GHz) bands of microwaves, or other bands of electromagnetic signals.

In the example of FIG. 1, trimmer device 2 includes input waveguide 4, transition sections 6 and 26, adjustable rotation joints 10 and 20, attenuation section 12, quarter-wave plate sections 16 and 22, and output waveguide 30. Transition sections 6 and 26 include mode suppressors 8 and 28, respectively. Attenuation section 12 includes attenuation vane 14. Quarter-wave plate sections 16 and 22 include quarter-wave plates 18 and 24, respectively. As shown in FIG. 1 by tabs at each end that measure approximately a quarter wavelength, each of mode suppressors 8 and 28, attenuation vane 14, and quarter-wave plates 18 and 24 may include quarter-wave matching transformers.

Trimmer device 2 may, in the example of FIG. 1, receive a microwave signal at input waveguide 4. Input waveguide 4 may be any structure capable of conveying electromagnetic waves between two endpoints. Example waveguides include hollow metal tubes, solid dielectric rods, optical fibers, and other means of propagating electromagnetic waves. Furthermore, input waveguide 4 may be a rectangular waveguide (e.g., a tube or rode having a rectangular cross section), a circular waveguide (e.g., having a circular cross section), an elliptical waveguide, or other type of waveguide. In the example of FIG. 1, where trimmer device 2 is operating on signals in the Ku Band, input waveguide 4 may be a WR75 rectangular waveguide as defined by the Electronic Industries Alliance. The WR75 waveguide may be operable to transmit frequencies ranging from 10-15 GHz.

Waveguides, generally, may propagate a signal via a single mode or multiple modes. Each mode may represent a field type (e.g., electric, magnetic, or some combination thereof) and direction of oscillation of a signal. Transverse electric (TE) modes have no electric field in the direction of propagation. Transverse magnetic (TM) modes have no magnetic field in the direction of propagation. Other types of modes include transverse electromagnetic (TEM) modes and hybrid modes. The mode having the lowest cutoff frequency for a particular waveguide is called the dominant mode of the guide. For rectangular and circular (e.g., hollow pipe) waveguides, the dominant modes are designated as the $TE_{1,0}$ mode and the $TE_{1,1}$ mode, respectively. In some examples, the size of a waveguide may be chosen to ensure that only the dominant mode can exist in the frequency band of operation.

Input waveguide 4 may receive an input signal from any acceptable source, such as a power amplifier (e.g., a TWTA or a solid-state amplifier) or other source. Input waveguide 4 may propagate the signal from one end of input waveguide 4, out the other end of input waveguide 4. As a WR75 waveguide, input waveguide 4 may propagate the input signal via a single mode (e.g., the $TE_{1,0}$ mode). That is, in the example of FIG. 1, input waveguide 4 may propagate the signal as an electric field oscillating in the Z-axis. Thus, the signal output by input waveguide 4 may have a single transverse axis (e.g., the Z-axis of FIG. 1) along which the amplitude of an electric field changes as the wave propagates through a medium (e.g., air). Input waveguide 4 may be coupled to a transition section, such as transition section 6.

In the example of FIG. 1, transition section 6 is a section of waveguide operable to receive the signal from input waveguide 4 and transition the signal from the $TE_{1,0}$ mode of input waveguide 4 to a $TE_{1,1}$ mode of a circular waveguide. In other examples, transition section 6 may be any other means for transitioning the signal. In any case, transition section 6 may receive the signal at a first end of transition section 6.

Transition section 6, in the example of FIG. 1, includes mode suppressor 8. Mode suppressor 8 may significantly attenuate or eliminate any reflected $TE_{1,1}$ mode (e.g., of the undesired orthogonal orientation) arriving from attenuation section 12. For instance, mode suppressor 8 may terminate the $TE_{1,1}$ mode having an electric field aligned along the X-Axis at the coupling interface between input waveguide 4 and transition section 6. Reflection of such undesired orthogonal modes may cause resonance that can degrade performance. Mode suppressor 8, in some examples, may be a resistive vane or plate bisecting a dual mode waveguide (e.g., transition section 6) that allows one mode to pass through while attenuating or terminating an orthogonal mode with little reflection. In some examples, mode suppressor 8 may fit into slots or grooves on the inner walls of transition section 6. In other examples, mode suppressor 8 may otherwise be incorporated into transition section 6. In the example of FIG. 1, mode suppressor 8 may be a thin (e.g., 10 mil) vane of Biaxially-oriented polyethylene terephthalate (BoPET). In other examples, mode suppressor 8 may be mica, Polyetherimide, alumina, or any other suitable material. The vane may have a thin resistive film deposited on one or both sides of the vane. In some examples, the thin resistive film may have a resistance of 125 Ohms per square, though other resistance values may also be used.

In addition to the suppression of undesired modes, transition section 6 may transition the received signal from one type of waveguide structure to a second type. In the example of FIG. 1, for instance, transition section 6 may transition the signal from input waveguide 4 to a circular waveguide. That is, transition section 6 may facilitate the transition of the $TE_{1,0}$ dominant mode received from input waveguide 4 at the first end of transition section 6 to a $TE_{1,1}$ dominant mode of a circular waveguide for output at the second end of transition section 6. The signal may exit transition section 6 as a linearly polarized signal, having an electrical field component oscillating in the Z-axis, corresponding to the $TE_{1,1}$ mode of attenuation section 12.

In the example of FIG. 1, the second end of transition section 6 is connected to adjustable rotation joint 10. Adjustable rotation joint 10 may be a joint or connection between two sections of circular waveguide that allows for rotation of one section with respect to the other. For instance, in the example of FIG. 1, adjustable rotation joint 10 couples transition section 6 to attenuation section 12 and allows for rotation of one section, with respect to the other, around the Y-axis as shown in FIG. 1. Thus, by changing the rotation angle of adjustable rotation joint 10, the relative angle between transition section 6 and attenuation section 12 may be set to any desired quantity.

Attenuation section 12, in the example of FIG. 1, is a section of circular waveguide (e.g., a cylindrical metal pipe) operable to receive the signal from transition section 6 (e.g., via adjustable rotation joint 10) at a first end of attenuation section 12 and provide variable attenuation of the received signal. In other examples, attenuation section 12 may be any other means for providing variable attenuation of an input signal. The amount of attenuation provided by attenuation section 12 may vary based on the relative rotation angle of attenuation section 12 with respect to transition section 6.

In the example of FIG. 1, attenuation section 12 includes attenuation vane 14. Attenuation vane 14 may operate to attenuate a received signal. In some examples, attenuation vane 14 may be a plate that is located and centered by longitudinal notches or grooves on the inner wall of attenuation section 12. In other examples, attenuation vane 14 may be otherwise part of attenuation section 12. Attenuation vane 14 may act to absorb a portion of the electromagnetic signal which passes through attenuation section 12. Similar to mode suppressor 8, attenuation vane 14 may, in some examples, be a thin (e.g., 10 mil) vane of BoPET, mica, Polyetherimide, alumina, or any other suitable material. The vane may have a thin resistive film deposited on one or both sides. In one example, the thin resistive film may have a resistance of 125 Ohms per square. In other examples, the thin resistive film may have other resistance values. As the changing electric field propagates from the first end of attenuation section 12 and through attenuation section 12, attenuation vane 14 may absorb some of the electric field of the signal (e.g., a component of the signal that is parallel to the surfaces of attenuation vane 14), thereby attenuating the signal. Attenuation vane 14, in the example of FIG. 1, may have sufficient length to provide approximately 40 dB minimum attenuation when oriented at 90 degrees. That is, in the example of FIG. 1, attenuation section 12 may receive a signal having an electric field component oscillating in the Z-axis. When attenuation section 12 is rotated with respect to transition section 6 such that the surfaces of attenuation vane 14 are parallel to the Z-axis, attenuation section 12 may provide maximum attenuation of the received signal. When the surfaces of attenuation vane 14 are parallel to the X-axis, attenuation section may provide no or minimal attenuation of the received signal. While shown in the example of FIG. 1 as a circular waveguide with an attenuation vane, attenuation section 12 may, in other examples, be any other means of attenuating a signal, such as a waveguide with longitudinal slots feeding orthogonal waveguides which would couple depending on the rotation angle, or an orthomode transducer (OMT). In any case, the resulting output signal at the second end of attenuation section 12 may have a smaller amplitude compared to the amplitude of the signal received at the first end of attenuation section 12. For instance, the output signal at the second end of attenuation section 12 may consist primarily of the electrical field component that is perpendicular to the surfaces of attenuation vane 14. In such instance, the output signal may have an electric field component oscillating in the plane perpendicular to the surfaces of attenuation vane 14.

In the example of FIG. 1, first quarter-wave plate section 16 is connected to the second end of attenuation section 12. First quarter-wave plate section 16 may be a section of circular waveguide. In some examples, attenuation section 12 and first quarter-wave plate section 16 are two portions of the same circular waveguide. In other examples, each of attenuation section 12 and first quarter-wave plate section 16 are separate sections of circular waveguide coupled together. Thus, to adjust the amplitude of the signal (e.g., attenuate the signal), attenuation section 12 and first quarter-wave plate section 16 (e.g., including attenuation vane 14 and quarter-wave plate 18) rotate as a pair. In the example of FIG. 1, attenuation section 12 and first quarter-wave plate section 16 may be coupled such that a 45 degree angle of separation between attenuation vane 14 and quarter-wave plate 18 is maintained at all times.

First quarter-wave plate section 16 may be any device operable to receive a linearly polarized signal at a first end (e.g., from attenuation section 12) and convert the signal into a circularly polarized signal or vice versa. That is, in some examples, first quarter-wave plate section 16 may be a dual mode waveguide that provides a differential phase shift of 90 degrees between two modes of a signal. In other examples, first quarter-wave plate section 16 may be a series of inductive rods across a dual mode waveguide, capacitive projections into a dual mode waveguide, or any other means for introducing a differential phase shift between two modes of a signal. In any case, as the electromagnetic signal enters first quarter-wave plate section 16, the signal may include an electric field oscillating in a single axis (e.g., along the X-axis, the Z-axis, or some combination thereof) perpendicular to the surfaces of attenuation vane 14. First quarter-wave plate section 16 may change the signal such that the signal exiting first quarter-wave plate section 16 is circularly polarized, having an electric field that is changing angularly. In other words, the electric field exiting first quarter-wave plate section 16 may have an electric field that maintains the same amplitude, but instead changes direction in a radial fashion (e.g., changing from parallel to the X-axis to perpendicular to the X-axis then parallel again, etc.) as it travels along the axis of transmission (e.g., the Y-axis of FIG. 1). In other examples, the received signal may be circularly polarized, and first quarter-wave plate section 16 may change the signal to a linearly polarized signal.

First quarter-wave plate section 16, in the example of FIG. 1, includes quarter-wave plate 18. In some examples, quarter-wave plate 18 may be a dielectric plate oriented at 45 degrees with respect to attenuation vane 14. The 45 degree difference may allow the signal received from attenuation section 12 to be resolved in to two orthogonal components: one that will encounter minimum dielectric loading from quarter-wave plate 18 and one that will encounter maximum dielectric loading. For instance, quarter-wave plate 18 may be a slab of cross-linked polystyrene, 0.125 inches thick and the correct length to provide a 90 degree differential phase shift. In some examples, quarter-wave plate 18 may be located and centered by longitudinal grooves or notches in the inner wall of first quarter-wave plate section 16. In other examples, quarter-wave plate 18 may be otherwise incorporated into first quarter-wave plate section 16. That is, quarter-wave plate 18 may be any means for introducing a differential phase shift (e.g., of 90 degrees) between two modes of a signal. In circular waveguides, a linear voltage, such as at the input of first quarter-wave plate section 16, may be resolved into two orthogonal vectors that add vectorially to compose the input signal. As the two orthogonal vectors propagate the length of quarter-wave plate 18, the vectors undergo a differential phase shift. Thus, in the example of FIG. 1, the signal exiting first quarter-wave plate section 16 may be circularly polarized (e.g., having two orthogonal components that are 90 degrees out of phase).

In the example of FIG. 1, a second end of first quarter-wave plate section 16 is connected to adjustable rotation joint 20. Adjustable rotation joint 20 may be a joint or connection between two sections of circular waveguide that allows for rotation of one section with respect to the other. For instance, in the example of FIG. 1, adjustable rotation joint 20 couples first quarter-wave plate section 16 to second quarter-wave plate section 22 and allows for rotation of one section with respect to the other, around the Y-axis as shown in FIG. 1. Thus, by changing the rotation angle of adjustable rotation joint 20, the relative angle between quarter-wave plate 18 and quarter-wave plate 24 may be set to any desired quantity.

Second quarter-wave plate section 22 may be a section of circular waveguide. Second quarter-wave plate section 22 may be similar to first quarter-wave plate section 16. That is, second quarter-wave plate section 22 may be any means for receiving a linearly polarized signal (e.g., from attenuation section 12) and converting the signal into a circularly polarized signal or vice versa. Thus, as an electromagnetic signal is received from first quarter-wave plate section 16, the signal may include an electric field having a constant amplitude, but oscillating angularly around the axis of transmission (e.g., the Y-axis of FIG. 1). Second quarter-wave plate section 22 may change the signal such that the signal exiting second quarter-wave plate section 22 has an electric field that is oscillating along a single axis (e.g., in a plane that is at a 45 degree orientation to quarter-wave plate 24).

Second quarter-wave plate section 22, in the example of FIG. 1, includes quarter-wave plate 24. Quarter-wave plate 24 may be the same or similar to quarter-wave plate 18. In some examples, quarter-wave plate 24 may be a slab of cross-linked polystyrene that is the correct length to provide a 90 degree differential phase shift between two orthogonal components of a received signal. Quarter-wave plate 24 may be may be located and centered by longitudinal grooves or notches in the inner wall of second quarter-wave plate section 22. In other examples, quarter-wave plate 24 may be otherwise incorporated into second quarter-wave plate section 22. That is, quarter-wave plate 24 may be any device operable to introduce a differential phase shift of 90 degrees between two modes of a signal.

In some examples, second quarter-wave plate section 22 may introduce a differential phase shift between modes of a signal in the opposite direction of the phase shift introduced by first quarter-wave plate section 16. For instance, if first quarter-wave plate section 16 converts a linearly polarized signal into a circularly polarized signal having a left-handed rotation, second quarter-wave plate section 22 would convert the same linearly polarized signal into a circularly polarized signal having a right-handed rotation. By introducing a phase shift in the opposite direction, second quarter-wave plate section 22 may convert a signal received from first quarter-wave plate section 16 into a signal having the same polarization as the signal that was received by first quarter-wave plate section 16. For instance, a linearly polarized signal would be changed to circularly polarized by first quarter wave-plate section 16 and then converted back to a linearly polarized signal by second quarter-wave plate section 22. In other examples, second quarter-wave plate section 22 may introduce a phase shift exactly the same as first quarter-wave plate section 16. Because first quarter-wave plate section 16 and second quarter-wave plate section 22 are rotatable with respect to one another, the type of phase shift may be the same or opposite without significant effect.

Second quarter-wave plate section 22 may be rotatable using adjustable rotation joint 20, in order to change the angle between quarter-wave plate 18 and quarter-wave plate 24. By adjusting the angle between quarter-wave plates 18 and 24, first quarter-wave plate section 16 and second quarter-wave plate section 22 may be operable to shift the phase attic received signal by a variable amount. The amount of phase shift introduced to the signal may be proportional to the angle of rotation of adjustable rotation joint 20. For instance, the shift in phase introduced to the signal in electrical degrees may be directly proportional to the angular difference between the surfaces of quarter-wave plate 18 and the surfaces of quarter-wave plate 24 in mechanical degree. In other words, phase change may be continuous, without limit, in both negative and positive rotations.

Any angular orientation (e.g., by rotating adjustable rotation joint 20) between quarter-wave plates 18 and 24 may be defined as the "zero" phase state. By rotating adjustable rotation joint 20 by 90 degrees from the zero-phase state, trimmer device 2 may introduce a phase shift to the signal of 90 degrees. By rotating adjustable rotation joint 20 to 180 degrees, trimmer device 2 may invert the signal (e.g., provide a 180 degree phase shift). The overall rotation of second quarter-wave plate section 22 (e.g., as well as transition section 26 and output waveguide 30) may be the sum of the rotation angle of adjustable rotation joint 10 and the rotation angle of adjustable rotation joint 20.

In the example of FIG. 1, transition section 26 is connected to the second end of second quarter-wave plate section 22. Transition section 26 may be the same or similar to transition section 6 as previously described. However, transition section 26 may be oriented in reverse. Therefore, transition section 26 may be operable to transition a received signal from a circular waveguide to a rectangular waveguide and suppress unwanted modes.

As shown in the example of FIG. 1, transition section 26 includes mode suppressor 28. Mode suppressor 28 may be the same or similar to mode suppressor 8 as previously described. Mode suppressor 28 may be fitted within transition section 26 by slots or grooves in the inner walls of transition section 26. Mode suppressor 28 may perform the same or similar functions to those performed by mode suppressor 8. That is, mode suppressor 28 may significantly attenuate or eliminate any reflected $TE_{1,1}$ mode (e.g., of the undesired orthogonal orientation) from second quarter-wave plate section 22. Transition section 26 and mode suppressor 28 may rotate along with second quarter-wave plate section 22.

In the example of FIG. 1, output waveguide 30 is connected to transition section 26. Output waveguide 30 may be similar to input waveguide 4. Output waveguide 30 may rotate along with transition section 26 and second quarter-wave plate section 22. Thus, to attain a specific attenuation and a specific phase shift, either the input port or the output port may be able to rotate with respect to one another. For instance, in the example of FIG. 1, input waveguide 4 may not rotate. Instead, output waveguide 30 may rotate to achieve a desired attenuation and phase shift.

In some examples, output waveguide 30 may be a rectangular waveguide, such as the WR75 waveguide used for Ku band microwave signals. Output waveguide 30 may provide an output signal for various applications, such as paralleling the output of power amplifiers. The output signal may be a representation of the input signal received by trimmer device 2. The attenuation of the output signal may be controlled by the angle of adjustable rotation joint 10, and the phase of the output signal may be controlled by the angle of adjustable rotation joint 20.

In the example of FIG. 1, the attenuation may be defined by Equation 1 below and the phase shift may be defined by Equation 2 below, where ∠A is the rotation angle of adjustable rotation joint 10 and ∠B is the rotation angle of adjustable rotation joint 20.

$$\text{Attenuation (in dB)} = 10\log(\cos^2(\angle A)) \quad (1)$$

$$\text{Phase change} = \angle B \quad (2)$$

In this way, amplitude and phase trimmer device 2 of FIG. 1 may provide a more compact and lightweight device for modifying the phase and amplitude of electromagnetic signals such as microwaves. By using a first adjustable rotation joint between an input waveguide section and an attenuation section, trimmer device 2 may provide variable attenuation or reduction of the amplitude of an input signal. Furthermore, by providing a second adjustable rotation joint between two quarter-wave plate sections, trimmer device 2 may provide a way to variably shift the phase of the input signal to produce a modified output signal.

As described in the example of FIG. 1 above, attenuation section 12, first quarter-wave plate section 16, and second quarter-wave plate section 22 may be one or more sections of hollow conductive piping. In some examples, the sections of piping may be filled with a gas (e.g., air or other gas) or a fluid. In some examples, attenuation section 12, first quarter-wave plate section 16, and/or second quarter-wave plate section 22 may be solid waveguides. That is, attenuation section 12, first quarter-wave plate section 16, and/or second quarter-wave plate section 22 may be dielectric waveguides, ferromagnetic waveguides, or other suitable means for propagating electromagnetic signals. In some examples, attenuation vane 14, quarter-wave plate 18 and/or quarter-wave plate 24 may be permanent magnet structures or other inductive means for altering electromagnetic signals.

Figure 2:
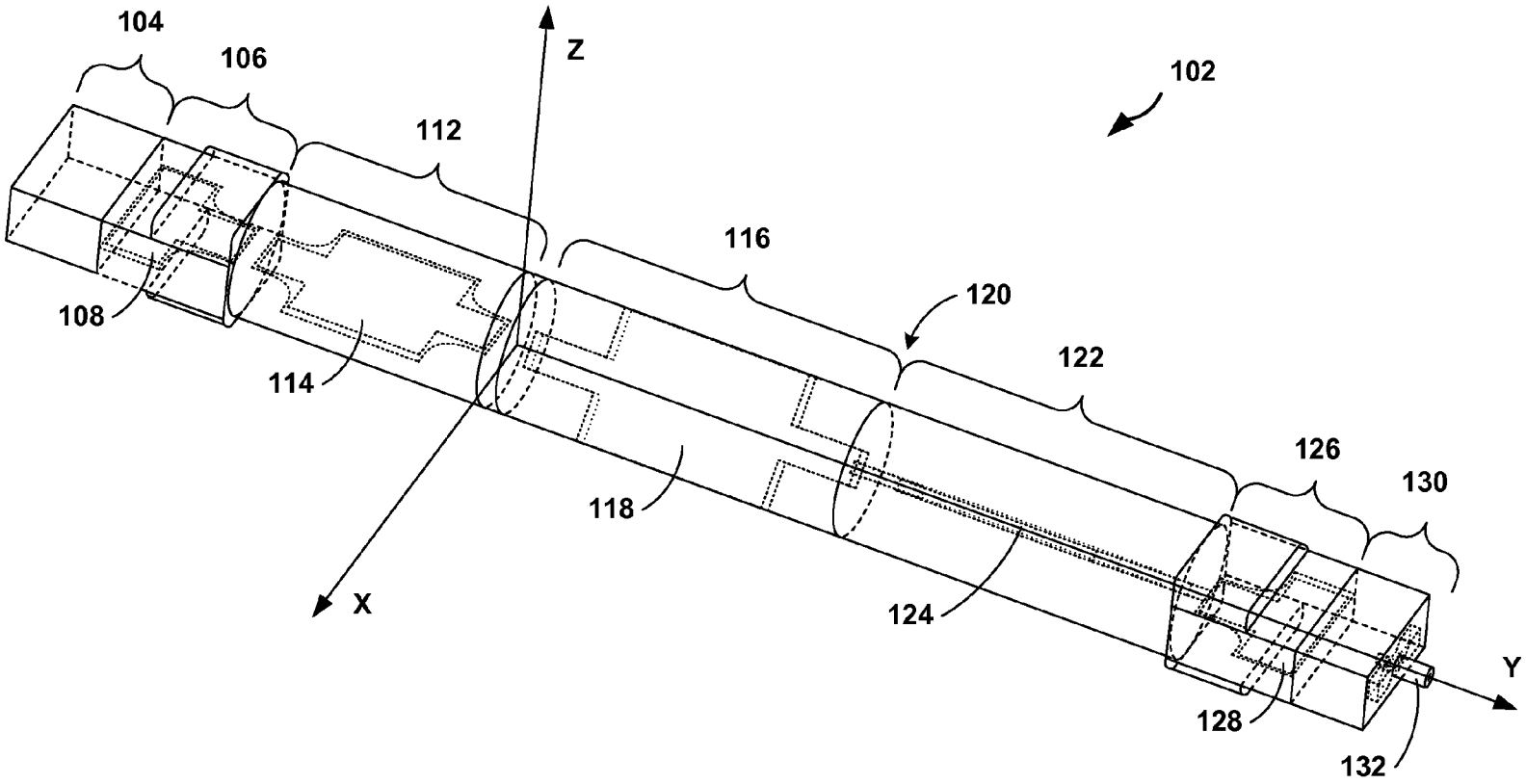
FIG. 2 is a block diagram illustrating an example amplitude and phase trimmer device, in accordance with one or more techniques of the present disclosure.

FIG. 2 is a block diagram illustrating an example amplitude and phase trimmer device 102, in accordance with one or more techniques of the present disclosure. Trimmer device 102 is described in the example of FIG. 2 as operating within the Ku band of microwave signals from 12.2 to 12.7 Gigahertz (GHz). For instance, trimmer device 102 of FIG. 1 may be useful at the 20 GHz frequencies for satellite down links. In other examples, trimmer device 102 may be scalable to a number of other frequency bands, such as the Ka (26.5-40 GHz) or U (40-60 GHz) bands of microwaves, or other bands of electromagnetic signals.

In the example of FIG. 2, trimmer device 102 includes input waveguide 104, transition sections 106 and 126, adjustable rotation joints 110 and 120, attenuation section 112, and quarter-wave plate sections 116 and 122. Trimmer device 102 also includes output coaxial adapter 130. Transition sections 106 and 126 include mode suppressors 108 and 128, respectively. Attenuation section 112 includes attenuation vane 114. Quarter-wave plate sections 116 and 122 include quarter-wave plates 118 and 124, respectively. As shown in FIG. 2 by tabs at each end that measure approximately a quarter wavelength, each of mode suppressors 108 and 128, attenuation vane 114, and quarter-wave plates 118 and 124 may include quarter-wave matching transformers.

In the example of FIG. 2, each of input waveguide 104, transition sections 106 and 126, adjustable rotation joints 110 and 120, attenuation section 112, quarter-wave plate sections 116 and 122, mode suppressors 108 and 128, attenuation vane 114, and quarter-wave plates 118 and 124 may be the same or similar to input waveguide 4, transition sections 6 and 26, adjustable rotation joints 10 and 20, attenuation section 12, quarter-wave plate sections 16 and 22, mode suppressors 8 and 28, attenuation vane 14, and quarter-wave plates 18 and 24, respectively. That is, all components of trimmer device 102, except output coaxial adapter 130, may be the same or similar to the components of trimmer device 2 as described in FIG. 1.

In some examples, such as where one or more compact amplitude and phase trimmer devices are used to parallel two power amplifiers, the amplitude and phase corrections may be sufficiently small, such that a flex waveguide or a length of coaxial cable could be used to take care of the rotation of the output waveguide with respect to the input waveguide. If a full range of adjustments is needed, such as from 0 to 20 dB or more of attenuation and 0 to 360 degrees of phase shift, a second configuration of the compact amplitude and phase trimmer (e.g., trimmer device 102) may be used.

Trimmer device 102, in the example of FIG. 2, includes output coaxial adapter 130. Output coaxial adapter 130 may include connection 132. Connection 132 may be a centered coaxial connection that allows for unlimited rotation. Output coaxial adapter 130 may receive the attenuated and phase-shifted signal from transition section 126 and transition the signal to be output via a coaxial cable attached to connection 132. Thus, output coaxial adapter 130 allows the output port to rotate a flat 360 degrees without having to accommodate a rotating output waveguide. That is, in the example of FIG. 2, input waveguide 104 may not rotate. Output coaxial adapter 130 may be able to rotate to determine a specific attenuation and phase shift. Once adjustable rotation joints 110 and 120 have been set to the proper angle, a connecter outer nut (e.g., of a coaxial cable) may be tightened to connection 132. In other examples, connection 132 may include a coaxial rotary joint.

While described herein as having a stationary input and a rotating output, techniques of the present disclosure may also use the compact amplitude and phase trimmer with the output in a stationary fashion while an input waveguide rotates to achieve the correct phase shift and attenuation. That is, the compact amplitude and phase trimmer device may be reciprocal.

As described in the example of FIG. 2 above, attenuation section 112, first quarter-wave plate section 116, and second quarter-wave plate section 122 may be one or more sections of hollow conductive piping. In some examples, the sections of piping may be filled with a gas (e.g., air or other gas) or a fluid. In some examples, attenuation section 112, first quarter-wave plate section 116, and/or second quarter-wave plate section 122 may be solid waveguides. That is, attenuation section 112, first quarter-wave plate section 116, and/or second quarter-wave plate section 122 may be dielectric waveguides, ferromagnetic waveguides, or other suitable means for propagating electromagnetic signals. In some examples, attenuation vane 114, quarter-wave plate 118 and/or quarter-wave plate 124 may be permanent magnet structures or other inductive means for altering electromagnetic signals.

FIGS. 3A-3E are block diagrams illustrating an example amplitude and phase trimmer device, in accordance with one or more techniques of the present disclosure. The examples of FIGS. 3A-3E are described within the context of trimmer device 2 of FIG. 1. While trimmer device 2 is described in the examples of FIGS. 3A-3E as operating within the Ku Band, trimmer device 2 may be scalable for use in various other areas of the electromagnetic spectrum.

Figure 3B:
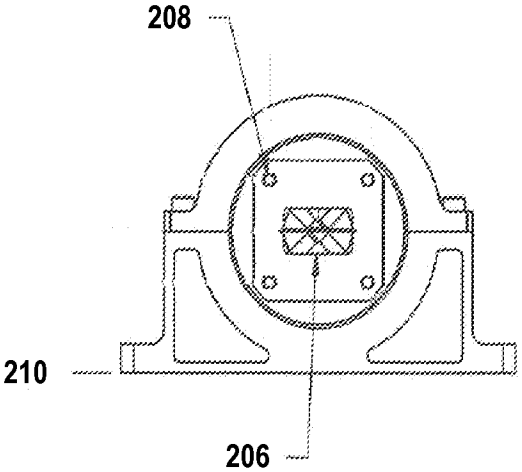
FIGS. 3A-3E are block diagrams illustrating an example amplitude and phase trimmer device, in accordance with one or more techniques of the present disclosure.
Figure 3A:
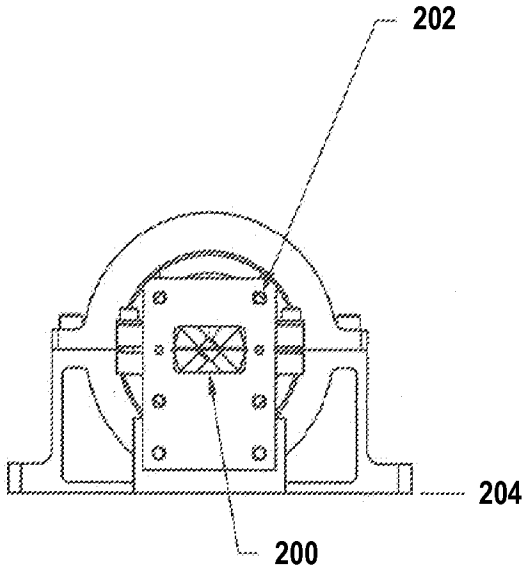

FIG. 3A is a side view of trimmer device 2, from the view of the input. As shown in FIG. 3A, trimmer device 2 includes input port 200. In some examples, input port 200 may be stationary. During operation, input port 200 may be coupled to a WR75 waveguide for receipt of microwave signals. Connection point 202 represents each of the four thread points at which a waveguide may be coupled to trimmer device 2. In the example of FIG. 3A, each connection point may be a 0.138-32 UNC-2B connection point having 0.210 full threads. Each of the connection points may be 0.497 inches to either side of the center of input port 200. Additionally, the connection points may be 0.478 inches above or below the center of input port 200. In the example of FIG. 3A, floor 204 may represent the floor of trimmer device 2 (e.g., where trimmer device 2 may be attached to a structure). Floor 204 may, in some examples, be 1.324 inches below the center of input port 200.

FIG. 3B is a side view of trimmer device 2, from the view of the output. As shown in FIG. 3B, trimmer device 2 includes output port 206. In some examples, output port 206 may rotate to achieve a particular attenuation and phase shift of an input signal. During operation, output port 206 may be coupled to a WR75 waveguide (e.g., a flexible waveguide) for output of modified microwave signals. Connection point 208 represents each of the four thread points at which a waveguide may be coupled to the output of trimmer device 2. In the example of FIG. 3B, each connection point may be a 0.138-32 UNC-2B connection point having 0.210 full threads. Each of the connection points may be 0.497 inches to either side of the center of output port 206. Additionally, the connection points may be 0.478 inches above or below the center of output port 206. In the example of FIG. 3B, floor 210 may represent the floor of trimmer device 2 (e.g., where trimmer device 2 may be attached to a structure). Floor 210 may be the same as, or different from floor 204. Floor 210, in some examples, may be 1.32.4 inches below the center of output port 206.

Figure 3C:
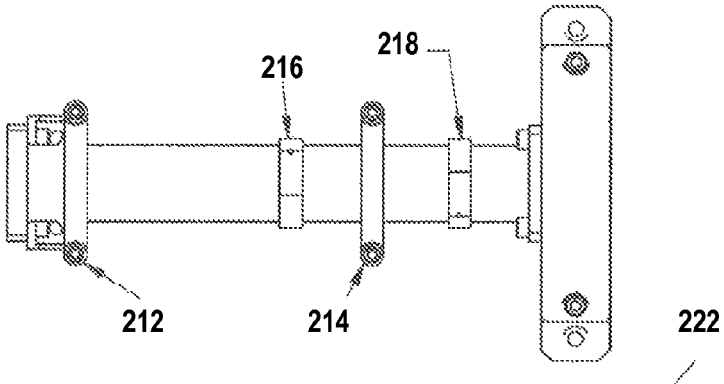

FIG. 3C is a top view of trimmer device 2. In the example of FIG. 3C, clamps 212 and 214 may cover adjustable rotation joints 10 and 20, respectively. Each of clamps 212 and 214 may include tightening mechanisms, such that once a proper rotation angle has been set using the adjustable rotation joints, the clamps can be tightened to avoid any further rotation. Adjustment point 216 represents a housing nut for rotating attenuation section 12 and first quarter-wave plate section 16, in order to change the attenuation of an input signal. Adjustment point 218 represents a housing nut for rotating second quarter-wave plate section 22, transition section 26, and output waveguide 30, in order to change the change in phase of the input signal. Adjustments at adjustment points 216 and 218 may, in some examples, be manual adjustments, such as when trimmer device 2 is connected to a power amplifier. In other examples, such as when trimmer device 2 is used in test applications, calibrated dials or computer controlled servo drives could be used to make adjustments. Test applications may benefit from the mathematical predictability and flatness with frequency of the amplitude and phase adjustments. Another possible application would be in array antennas, where weighting and phase of individual elements may need to be determined.

Figure 3D:
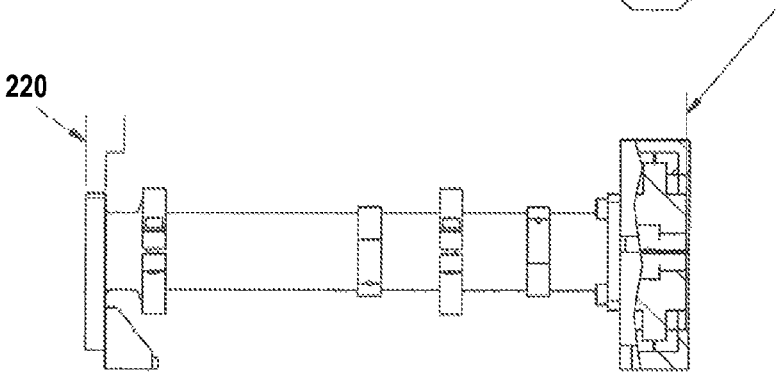
Figure 3E:
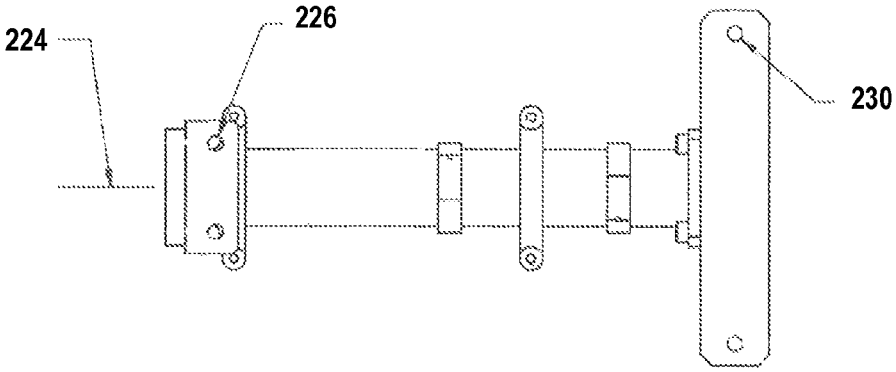

FIG. 3D is a side view of trimmer device 2. In the example of FIG. 3D, thickness 220 may represent the thickness of the coupling surface at the input to trimmer device 2. For instance, thickness 220 may be 0.210 inches. Length 222 may represent the total length of trimmer device 2 from end to end. In the example of FIG. 3D, length 222 may be 6.514 inches. FIG. 3E is a bottom view of trimmer device 2. Centerline 224 represents the center of both the input waveguide and the output waveguide. Connection point 226 represents the connect points on floor 204. Floor 204 may be 1.500 tall. Each connection point on floor 204 may be 0.500 inches above or below centerline 224 as shown in the example of FIG. 3E. Additionally, the connection points may be 0.540 inches from the left end of trimmer device 2 as shown in the example of FIG. 3E. Connection point 230 represents the connection points on floor 210. Floor 210 may be 4.00 inches tall and 0.750 inches wide. As shown in the example of FIG. 3E, each connection point on floor 210 may be 1.750 inches above or below centerline 224 and may be 0.375 inches from the right end of trimmer device 2. In some examples, both floor 204 and floor 210 may be 0.166 inches thick.

Figure 4:
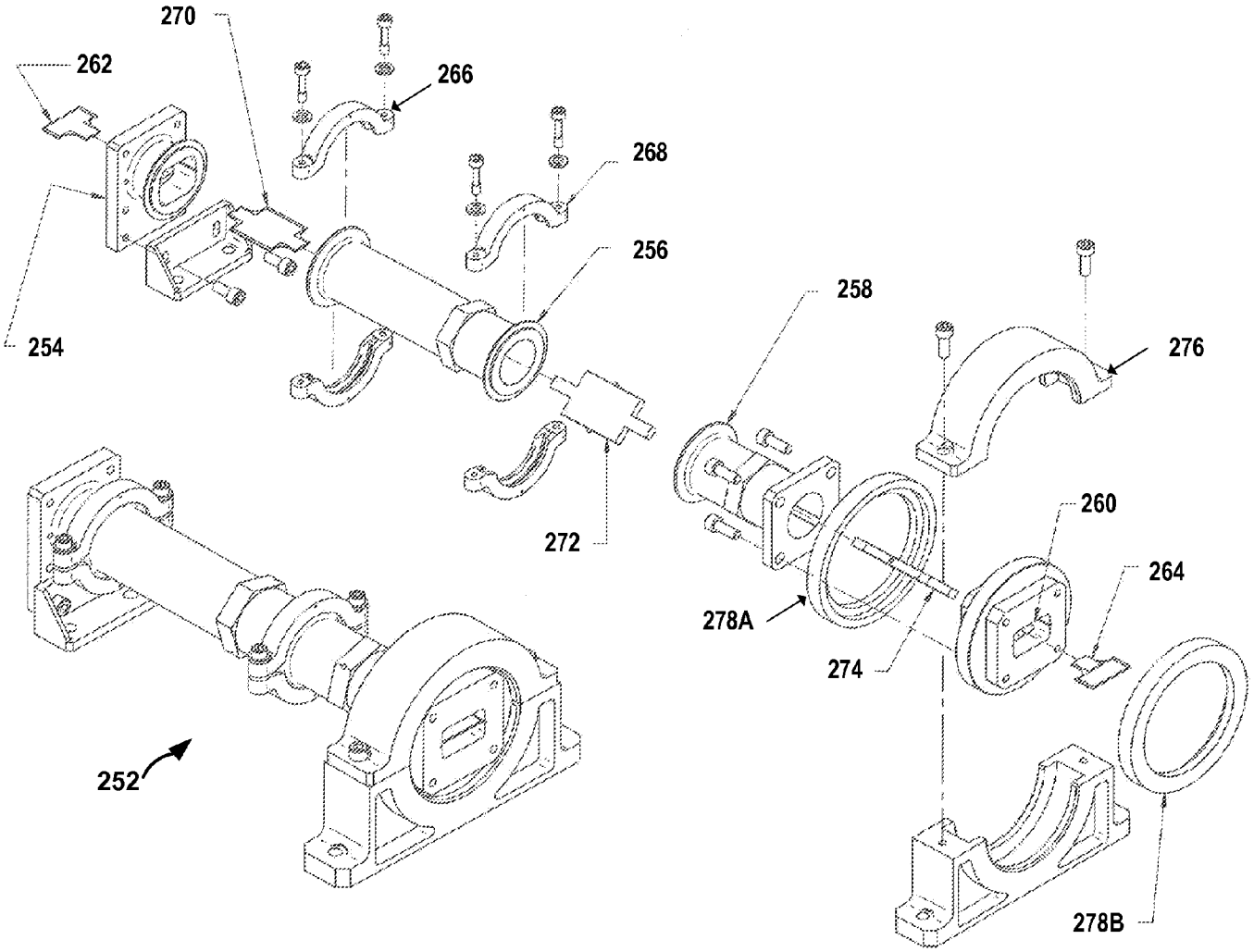
FIG. 4 is a block diagram illustrating an example amplitude and phase trimmer device, in accordance with one or more techniques of the present disclosure.

FIG. 4 is a block diagram illustrating an example amplitude and phase trimmer device 252, in accordance with one or more techniques of the present disclosure. FIG. 4 depicts both a complete, assembled view of one example of trimmer device 252, as well as a disassembled or "exploded" view. Trimmer device 252 is described in the example of FIG. 4 as operating within the Ku Band. In other examples, trimmer device 252 may be scalable for use in various other areas of the electromagnetic spectrum. Trimmer device 252 may be the same or similar to trimmer device 2 of FIG. 1.

In the example of FIG. 4, trimmer device 252 includes transition 254, amplitude trimmer cylinder 256, phase trimmer cylinder 258, and transition 260. Transitions 254 and 260 may be an example of transition sections 6 and 26, respectively. Transition 254 may mate to a WR75 waveguide (e.g., input waveguide 4 of FIG. 1) and be operable to receive an input signal and transition the signal from a rectangular waveguide to a circular waveguide. The first end of transition 254 may be flat to accommodate the rectangular waveguide, while the second end of transition 254 may be flanged. In the example of FIG. 4, transition 254 includes mode suppressor 262. Mode suppressor 262 may operate to suppress internal, undesired reflections. Transition 260 may also mate to a WR75 waveguide (e.g., output waveguide 30 of FIG. 1). Transition 260 may be operable to receive a signal and transition the signal from a circular waveguide to an output signal for a rectangular waveguide. In the example of FIG. 4, transition 260 includes mode suppressor 264. Mode suppressor 264 may operate to terminate internal, undesired modes.

Amplitude trimmer cylinder 256, in the example of FIG. 4, is a circular section of waveguide operable to receive a signal, attenuate the signal, and convert the signal from a linearly polarized signal to a circularly polarized signal. As shown in the example of FIG. 4, amplitude trimmer cylinder 256 includes resistive vane attenuator 270 and quarter-wave plate 272.

Amplitude trimmer cylinder 256 may be flanged on each end, for connection to other flanged circular waveguide sections via adjustment locking clamps. For instance, a first end of amplitude trimmer cylinder 256 may be connected to the second end of transition 254 by clamp 266. Clamp 266 may be used to lock amplitude trimmer cylinder 256 in place, once the proper rotation angle (e.g., at adjustable rotation joint 10) has been set to achieve the desired signal attenuation. After the desired rotation angle has been set, clamp 266 may be tightened (e.g., using screws or other tightening mechanisms), ensuring that amplitude trimmer cylinder 256 can no longer rotate.

In the example of FIG. 4, phase trimmer cylinder 258 may be a circular section of waveguide operable to convert a signal from a circularly polarized signal to a linearly polarized signal. Phase trimmer cylinder 258 includes quarter-wave plate 274. Using the combination of quarter-wave plate 272 and quarter-wave plate 274, a variable phase shift can be introduced to a signal. A first end of phase trimmer cylinder 258 may be connected to a second end of amplitude trimmer cylinder 256 by clamp 268. Clamp 268 may be used to lock phase trimmer cylinder 258 in place, once the proper rotation angle (e.g., at adjustable rotation joint 20) has been set to achieve the desired phase shift. After the desired rotation angle has been set, clamp 268 may be tightened, ensuring that phase trimmer cylinder 258 can no longer rotate with respect to amplitude trimmer cylinder 256. A second end of phase trimmer cylinder 258 may be connected to transition 260.

As shown in the example of FIG. 4, first end of trimmer device 252 (e.g., transition 254) may be stationary. That is, the first end may not rotate with respect to a mounting of trimmer device 252. A second end of trimmer device 252 (e.g., transition 260) may rotate to allow for amplitude and phase adjustments. Therefore, transition 260 may be housed in a mounting allowing for such rotation (e.g., mounting 276). In the example of FIG. 4, mounting 276 includes bushings 278A and 278B to ensure smooth rotation of transition 260. For instance, bushings 278A and 278B may be Polyetherimide bushings.

FIGS. 5A-5E are block diagrams illustrating an example amplitude and phase trimmer device, in accordance with one or more techniques of the present disclosure. The examples of FIGS. 5A-5E are described within the context of trimmer device 102 of FIG. 2. While trimmer device 102 is described in the examples of FIGS. 5A-5E as operating within the Ku Band, trimmer device 102 may be scalable for use in various other areas of the electromagnetic spectrum.

Figure 5B:
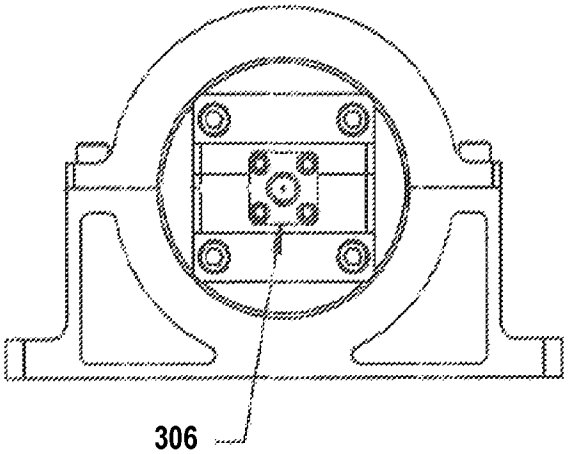
FIGS. 5A-5E are block diagrams illustrating an example amplitude and phase trimmer device, in accordance with one or more techniques of the present disclosure.
Figure 5A:
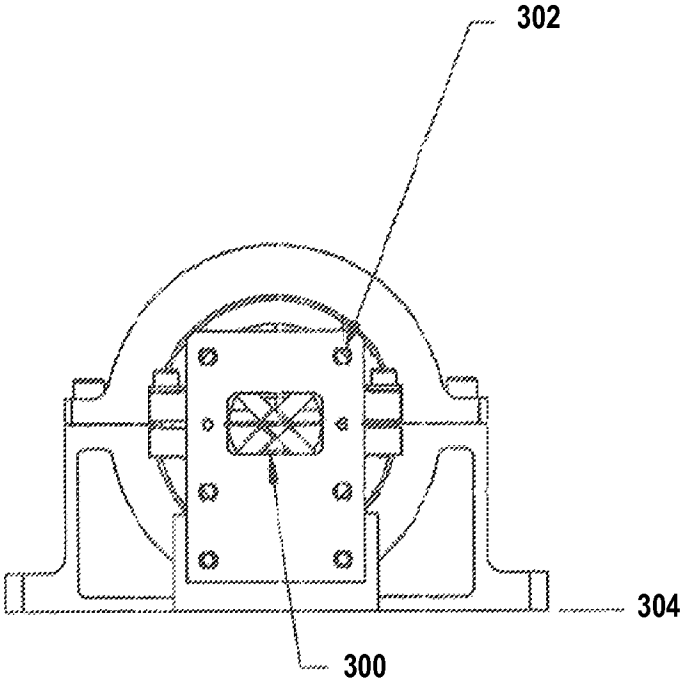

FIG. 5A is aside view of trimmer device 102, from the view of the input. As shown in the example of FIG. 5A, trimmer device 102 includes input port 300. In some examples, input port 300 may be stationary. During operation, input port 300 may be coupled to a WR75 waveguide for receipt of microwave signals. Connection point 302 represents each of the four thread points at which a waveguide may be coupled to trimmer device 102. In the example of FIG. 5A, each connection point may be a 0.138-32 UNC-2B connection point having 0.210 full threads. Each of the connection points may be 0.497 inches to either side of the center of input port 300. Additionally, the connection points may be 0.478 inches above or below the center of input port 300. In the example of FIG. 5A, floor 304 may represent the floor of trimmer device 102 (e.g., where trimmer device 102 may be attached to a structure). Floor 304 may, in some examples, be 1.324 inches below the center of input port 300.

FIG. 5B is a side view of trimmer device 102, from the view of the output. As shown in FIG. 5B, trimmer device 102 includes coaxial output port 306. In some examples, coaxial output port 306 may represent a female SubMiniature version A (SMA) connector. During operation, coaxial output port 306 may be coupled to a coaxial cable for output of modified microwave signals. Coaxial output port 306 may rotate a full 360 degrees to achieve a particular attenuation and phase shift of an input signal.

Figure 5C:
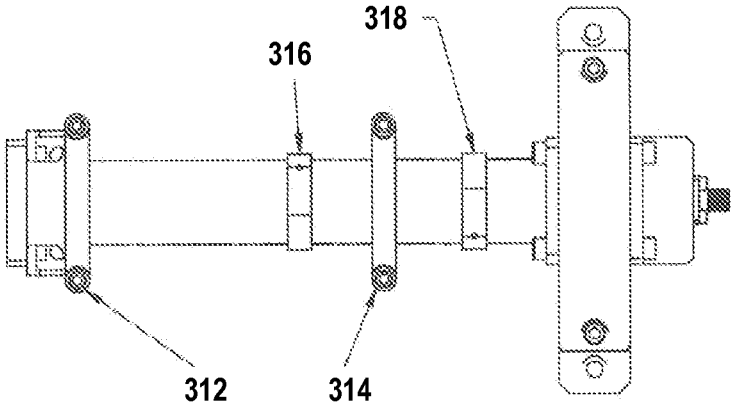

FIG. 5C is a top view of trimmer device 102. In the example of FIG. 5C, clamps 312 and 314 may cover adjustable rotation joints 110 and 120, respectively. Each of clamps 312 and 314 may include tightening mechanisms, such that once a proper rotation angle has been set using the adjustable rotation joints, the clamps can be tightened to avoid any further rotation. Adjustment point 316 represents a housing nut for rotating attenuation section 112 and first quarter-wave plate section 116, in order to change the attenuation of an input signal. Adjustment point 318 represents a housing nut for rotating second quarter-wave plate section 122, transition section 126, and output coaxial adapter 130, in order to change the change in phase of the input signal. Adjustments at adjustment points 316 and 318 may be manual adjustments or adjustments made using calibrated dials or computer controlled servo drives.

Figure 5D:
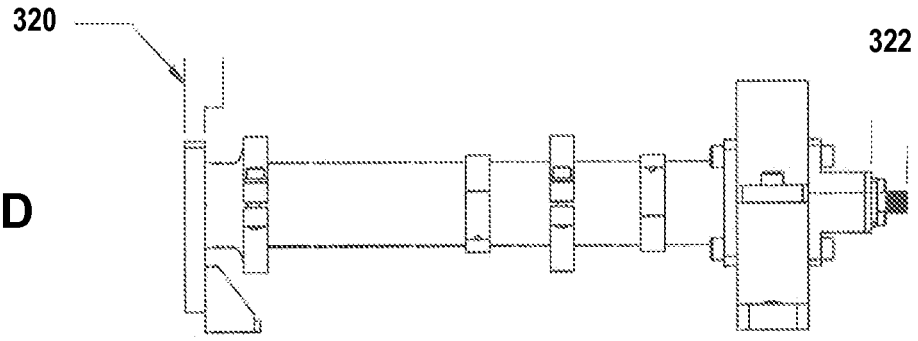

FIG. 5D is aside view of trimmer device 102. In the example of FIG. 5D, thickness 320 may represent the thickness of the coupling surface at the input to trimmer device 102. For instance, thickness 320 may be 0.210 inches. Length 322 may represent the length of the SMA connector at the output of trimmer device 102. In the example of FIG. 5D, length 322 may be 0.375 inches. Furthermore, in the example of FIG. 5D, trimmer device 102 may be a total 7.574 inches long.

Figure 5E:
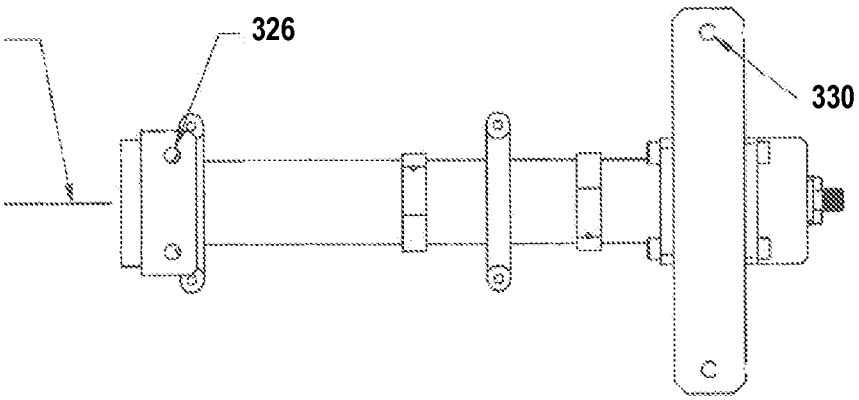

FIG. 5E is a bottom view of trimmer device 102. Centerline 324 represents the center of both the input waveguide and the output coaxial adapter. Connection point 326 represents the connect points on floor 304. Floor 304 may be 1.500 tall. Each connection point on floor 304 may be 0.500 inches above or below centerline 324 as shown in the example of FIG. 5E. Additionally, the connection points may be 0.540 inches from the left end of trimmer device 102 as shown in the example of FIG. 5E. Connection point 330 represents the connection points on the floor of the second attachment surface of trimmer device 102. The floor of the second attachment surface may be 4.00 inches tall and 0.750 inches wide. As shown in the example of FIG. 5E, each connection point on the second attachment surface may be 1.750 inches above or below centerline 324 and may be 0.375 inches from the right end of trimmer device 102. In some examples, both floor 304 and the floor of the second attachment surface may be 0.166 inches thick.

Figure 6:
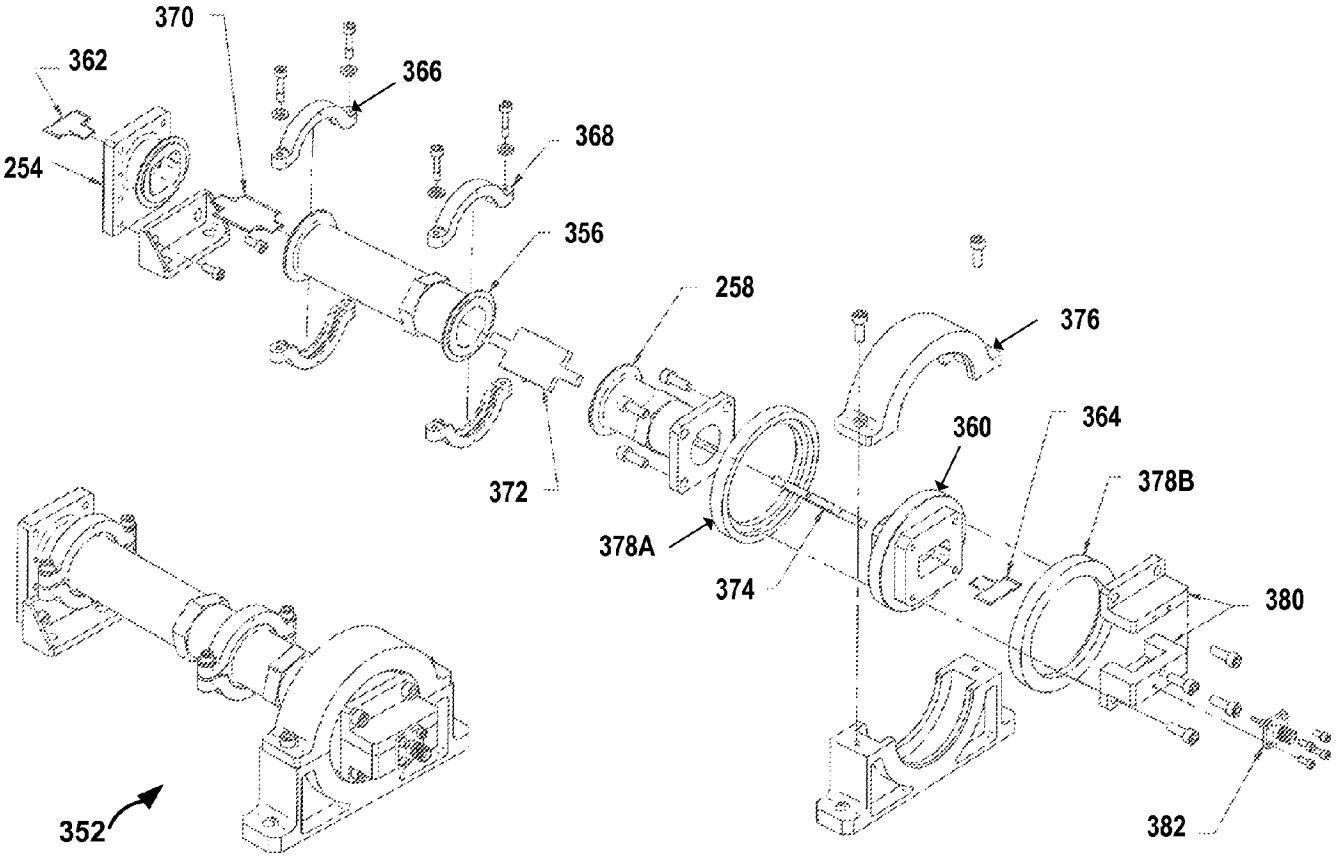
FIG. 6 is a block diagram illustrating an example amplitude and phase trimmer device, in accordance with one or more techniques of the present disclosure.

FIG. 6 is a block diagram illustrating an example amplitude and phase trimmer device 352, in accordance with one or more techniques of the present disclosure. FIG. 6 depicts both a complete, assembled view of one example of trimmer device 352, as well as a disassembled or "exploded" view. Trimmer device 352 is described in the example of FIG. 6 as operating within the Ku Band. In other examples, trimmer device 352 may be scalable for use in various other areas of the electromagnetic spectrum. Trimmer device 352 may be the same or similar to trimmer device 102 of FIG. 2.

In the example of FIG. 6, trimmer device 352 includes transition 354, amplitude trimmer cylinder 356, phase trimmer cylinder 358, transition 360, and SMA connector 382. Transitions 354 and 360 may be an example of transition sections 106 and 126, respectively. Transition 354 may mate to a WR75 waveguide (e.g., input waveguide 104 of FIG. 2) and be operable to receive an input signal and transition the signal from a rectangular waveguide to a circular waveguide. The first end of transition 354 may be Out to accommodate the rectangular waveguide, while the second end of transition 354 may be flanged. In the example of FIG. 6, transition 354 includes mode suppressor 362. Mode suppressor 362 may operate to terminate internal reflection of undesired modes. Transition 360 may mate to a coaxial adapter (e.g., output coaxial adapter 130 of FIG. 2). Transition 360 may be operable to receive a signal and transition the signal from a circular waveguide to an output signal for a coaxial adapter, or other waveguide. In the example of FIG. 6, transition 360 includes mode suppressor 364. Mode suppressor 364 may operate to terminate internal reflection of undesired modes.

Amplitude trimmer cylinder 356, in the example of FIG. 6, is a circular section of waveguide operable to receive a signal, attenuate the signal, and convert the signal from a linearly polarized signal to a circularly polarized signal. As shown in the example of FIG. 6, amplitude trimmer cylinder 356 includes resistive vane attenuator 370 and quarter-wave plate 372.

Amplitude trimmer cylinder 356 may be flanged on each end, for connection to other flanged circular waveguide sections via adjustment locking clamps. For instance, a first end of amplitude trimmer cylinder 356 may be connected to the second end of transition 354 by clamp 366. Clamp 366 may be used to lock amplitude trimmer cylinder 356 in place, once the proper rotation angle (e.g., at adjustable rotation joint 110) has been set to achieve the desired signal attenuation. After the desired rotation angle has been set, clamp 366 may be tightened e.g., using screws or other tightening mechanisms), ensuring that amplitude trimmer cylinder 356 can no longer rotate.

In the example of FIG. 6, phase trimmer cylinder 358 may be a circular section of waveguide operable to convert a signal from a circularly polarized signal to a linearly polarized signal. Phase trimmer cylinder 358 includes quarter-wave plate 374. Using the combination of quarter-wave plate 372 and quarter-wave plate 374, a variable phase shift can be introduced to a signal. A first end of phase trimmer cylinder 358 may be connected to a second end of amplitude trimmer cylinder 356 by clamp 368. Clamp 368 may be used to lock phase trimmer cylinder 358 in place, once the proper rotation angle (e.g., at adjustable rotation joint 120) has been set to achieve the desired phase shift. After the desired rotation angle has been set, clamp 368 may be tightened, ensuring that phase trimmer cylinder 358 can no longer rotate with respect to amplitude trimmer cylinder 356. A second end of phase trimmer cylinder 358 may be connected to transition 360.

Transition 360, in the example of FIG. 6, is connected to SMA connector 382 via coaxial adapter housing 380. Coaxial adapter housing 380 may be operable to receive a signal from a waveguide (e.g., transition 360) and transition the signal out a centered SMA connection (e.g., SMA connector 382) to a coaxial cable or other transmission conduit.

As shown in the example of FIG. 6, a first end of trimmer device 352 (e.g., transition 354) may be stationary. That is, the first end may not rotate with respect to a mounting of trimmer device 352. A second end of trimmer device 352 (e.g., transition 360) may rotate to allow for amplitude and phase adjustments. Therefore, transition 360 may be housed in a mounting allowing for such rotation (e.g., mounting 376). In the example of FIG. 6, mounting 376 includes bushings 378A and 378B to ensure smooth rotation of transition 360. For instance, bushings 378A and 378B may be Polyetherimide bushings.

Figure 7:
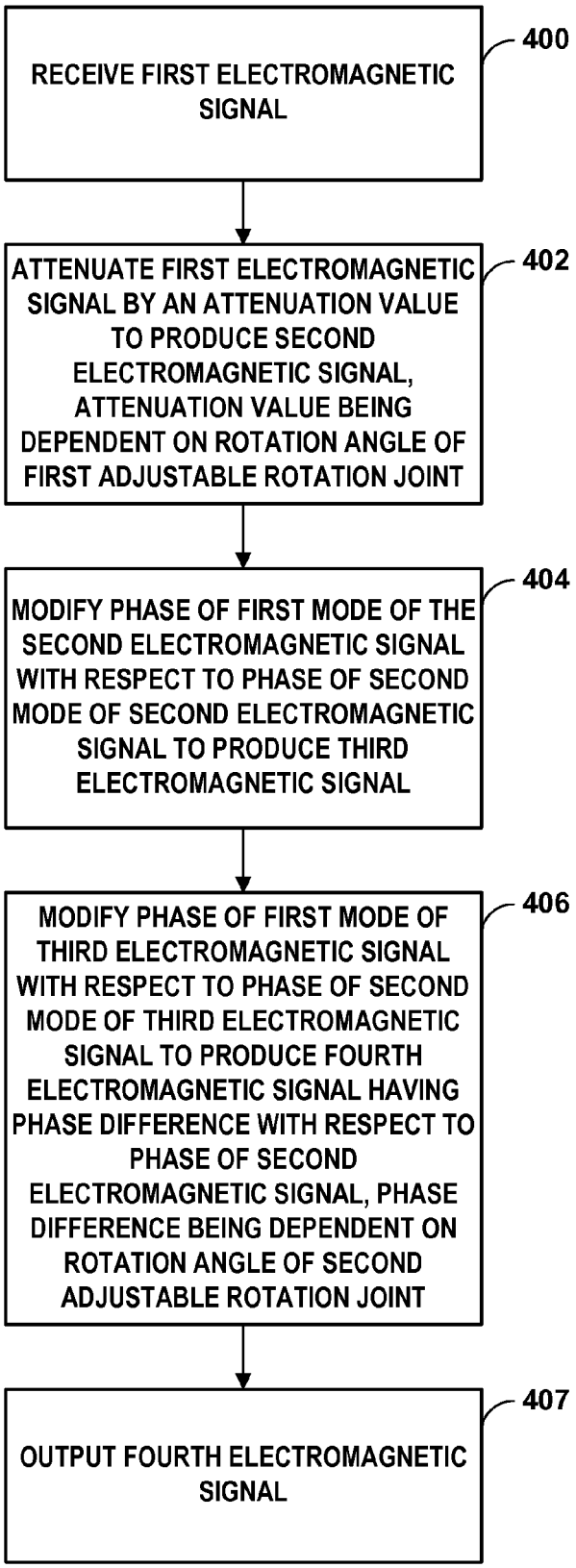
FIG. 7 is a flow diagram illustrating example operations of an amplitude and phase trimmer device, in accordance with one or more techniques of the present disclosure.

FIG. 7 is a flow diagram illustrating example operations of an amplitude and phase trimmer device, in accordance with one or more techniques of the present disclosure. For exemplary purposes only, the operations described in the example of FIG. 7 are described within the context of trimmer device 2 of FIG. 1.

In the example of FIG. 7, trimmer device 2 may receive a first electromagnetic signal at a first end of trimmer device 2 (400). The first end of trimmer device 2 may comprise an input section, such as input waveguide 4 and/or transition section 6. In some examples, the first electromagnetic signal may be linearly polarized.

Trimmer device 2 may, in the example of FIG. 7, attenuate the first electromagnetic signal by an attenuation value to produce a second electromagnetic signal (402). The second electromagnetic signal may, in some examples, have the same polarization as the first electromagnetic signal (e.g., linearly polarized). Trimmer device 2 may attenuate the second electromagnetic signal using an attenuation section such as attenuation section 12 including attenuation vane 14. The attenuation section may be coupled to the input section by a first adjustable rotation joint, such as adjustable rotation joint 10, and the attenuation value may be dependent upon a rotation angle of the first adjustable rotation joint.

In the example of FIG. 7, trimmer device 2 may modify a phase of a first mode of the second electromagnetic signal with respect to a phase of a second mode of the second electromagnetic signal to produce a third electromagnetic signal (404). Trimmer device 2 may modify the phase of the first mode of the second electromagnetic signal using a first phase-shifting section, such as first quarter-wave plate section 16 including first quarter-wave plate 18. By modifying the phase of a mode of the second electromagnetic trimmer device 2 may cause the third electromagnetic signal to be circularly polarized.

Trimmer device 2 may, in the example of FIG. 7, modify a phase of a first mode of the third electromagnetic signal with respect to a phase of a second mode of the third electromagnetic signal to produce a fourth electromagnetic signal (406). Trimmer device 2 may modify the phase of the first mode of the third electromagnetic signal using a second phase-shifting section, such as second quarter-wave plate section 22 including second quarter-wave plate 24. By modifying the phase of the first mode of the third electromagnetic signal, trimmer device 2 may cause the fourth electromagnetic signal to be linearly polarized. The second phase-shifting section may be coupled to the first phase-shifting section by a second adjustable rotation joint, such as adjustable rotation joint 20. The fourth electromagnetic signal may have a phase difference with respect to a phase of the second electromagnetic signal and the phase difference may be dependent upon a rotation angle of the second adjustable rotation joint.

In the example of FIG. 7, trimmer device 2 may output the fourth electromagnetic signal at a second end of trimmer device 2 (408). The second end of trimmer device 2 may comprise an output section, such as transition section 26 and/or output waveguide 30. In some examples, the output section may additionally or alternatively include a waveguide to coaxial adapter, such as output coaxial adapter 130 of FIG. 2. By modifying the amplitude and phase of the input signal, trimmer device 2 may provide a different signal at the output that is predictable based on the rotation angles of the first and second adjustable rotation joints.

In some examples, the output section of the amplitude and phase trimmer device comprises a coaxial adapter (e.g., output coaxial adapter 130 of FIG. 2), and trimmer device 2 may transition the fourth electromagnetic signal from a rectangular waveguide to a coaxial cable. In some examples, the attenuation value, in decibels, is equal to ten times the log of the cosine squared of the rotation angle of the first adjustable rotation joint. In some examples, each of the first electromagnetic signal, the second electromagnetic signal, the third electromagnetic signal, and the forth electromagnetic signal is within the Ku band of microwave electromagnetic radiation.

Various examples have been described. These and other examples are with the scope of the following claims.

What is claimed is:

1. A system comprising:

means for transitioning an electromagnetic signal from an input rectangular waveguide to a circular waveguide;

means for attenuating the electromagnetic signal, the means for attenuating being coupled to the means for transitioning via a first adjustable rotation joint;

a first polarization-conversion means for converting a polarization of the electromagnetic signal by introducing a first differential phase shift between a first mode of the electromagnetic signal, the first mode having a first orientation, and a second mode of the electromagnetic signal, the second mode having a second orientation that is orthogonal to the first orientation, wherein the first polarization-conversion means is coupled to the means for attenuating such that the first polarization-conversion means and the means for attenuating form a continuous section that rotates together as a pair; and a second polarization-conversion means for converting the polarization of the electromagnetic signal by introducing a second differential phase shift between the second mode of the electromagnetic signal and the first mode of the electromagnetic signal, the second polarization-conversion means being coupled to the first polarization-conversion means via a second adjustable rotation joint.

2. The system of claim 1, wherein the means for attenuating and the first polarization-conversion means are rotatable, at the first adjustable rotation joint and with respect to the means for transitioning, to a first rotation angle, the first rotation angle determining an attenuation of the electromagnetic signal.

3. The system of claim 2, wherein the second polarization-conversion means is rotatable, at the second adjustable rotation joint and with respect to the first polarization-conversion means, to a second rotation angle, the second rotation angle determining a change in phase of the electromagnetic signal.

4. The system of claim 3, wherein the change in phase of the electromagnetic signal is equal to the second rotation angle.

5. The system of claim 2, wherein the attenuation of the electromagnetic signal, in decibels, is equal to ten times a log of a cosine squared of the first rotation angle.

6. The system of claim 1, wherein the means for transitioning includes means for suppressing one or more reflected transverse modes of the electromagnetic signal while maintaining modes of the electromagnetic signal other than the transverse modes of the electromagnetic signal.

7. The system of claim 1, wherein the means for transitioning comprises a first means for transitioning, the system further comprising:

a second means for transitioning the electromagnetic signal from the circular waveguide to an output rectangular waveguide, the second means for transitioning being coupled to the second polarization-conversion means; and a third means for transitioning the electromagnetic signal to a coaxial cable, the third means for transitioning being coupled to the second means for transitioning.

8. A device comprising:

a waveguide transition section comprising a first mode suppressor, operable to receive an electromagnetic signal;

an attenuation section comprising a resistive vane attenuator, the attenuation section being coupled to the waveguide transition section via a first adjustable rotation joint, wherein the attenuation section is operable to attenuate the electromagnetic signal;

a first quarter-wave plate section comprising a first quarter-wave plate, the first quarter-wave plate section being coupled to the attenuation section such that the first quarter-wave plate section and the attenuation section form a continuous section that rotates together as a pair, wherein the first quarter-wave plate section is operable to introduce a first differential phase shift between a first component of the electromagnetic signal and a second component of the electromagnetic signal; and a second quarter-wave plate section comprising a second quarter-wave plate, the second quarter-wave plate section being coupled to the first quarter-wave plate section via a second adjustable rotation joint, wherein the second quarter-wave plate section is operable to introduce a second differential phase shift between the second component of the electromagnetic signal and the first component of the electromagnetic signal.

9. The device of claim 8, wherein the attenuation section and the first quarter-wave plate section are rotatable, at the first adjustable rotation joint and with respect to the waveguide transition section, to a first rotation angle, the first rotation angle determining an attenuation of the electromagnetic signal, wherein the attenuation of the electromagnetic signal, in decibels, is equal to ten times a log of a cosine squared of the first rotation angle.

10. The device of claim 9, wherein the second quarter-wave plate section is rotatable, at the second adjustable rotation joint and with respect to the first quarter-wave plate section, to a second rotation angle, the second rotation angle determining a change in phase of the electromagnetic signal, wherein the change in phase of the electromagnetic signal is equal to the second rotation angle.

11. The device of claim 8, wherein the waveguide transition section comprises a first waveguide transition section, the device further comprising:

a second waveguide transition section comprising a second mode suppressor, the second waveguide transition section being coupled to the second quarter-wave plate section, wherein the second waveguide transition section is operable to transition the electromagnetic signal from a circular waveguide to a rectangular waveguide; and an output waveguide, the output waveguide being a rectangular waveguide coupled to the second waveguide transition section.

12. The device of claim 8, wherein the waveguide transition section comprises a first waveguide transition section, the device further comprising:

a second waveguide transition section comprising a second mode suppressor, the second waveguide transition section being coupled to the second quarter-wave plate section, wherein the second waveguide transition section is operable to transition the electromagnetic signal from a circular waveguide to a rectangular waveguide; and a rectangular waveguide to coaxial adapter, the rectangular waveguide to coaxial adapter being coupled to the second waveguide transition section.

13. The device of claim 8, wherein the attenuation section and the first quarter-wave plate section comprise a first dual mode circular waveguide and wherein the second quarter-wave plate section comprises a second dual mode circular waveguide.

14. The device of claim 8, wherein each of the first quarter-wave plate and the second quarter-wave plate is made of cross-linked polystyrene.

15. The device of claim 8, wherein the first quarter-wave plate and second quarter-wave plate each comprises a magnetic quarter-wave plate.

16. A method comprising:

receiving, at a first end of an amplitude and phase trimmer device, a first electromagnetic signal, the first end of the amplitude and phase trimmer device comprising an input section;

attenuating, by an attenuation section of the amplitude and phase trimmer device, the first electromagnetic signal by an attenuation value to produce a second electromagnetic signal, wherein the attenuation section is connected to the input section by a first adjustable rotation joint, and wherein the attenuation value is dependent upon a rotation angle of the first adjustable rotation joint;

modifying, by a first phase-shifting section of the amplitude and phase trimmer device, a phase of a first mode of the second electromagnetic signal with respect to a phase of a second mode of the second electromagnetic signal to produce a third electromagnetic signal, wherein the first phase-shifting section is connected to the attenuation section such that the first phase-shifting section and the attenuation section form a continuous section that rotates together as a pair;

modifying, by a second phase-shifting section of the amplitude and phase trimmer device, a phase of a first mode of the third electromagnetic signal with respect to a phase of a second mode of the third electromagnetic signal to produce a fourth electromagnetic signal, the fourth electromagnetic signal having a phase difference with respect to a phase of the second electromagnetic signal, wherein the second phase-shifting section is connected to the first phase-shifting section by a second adjustable rotation joint, and wherein the phase difference is dependent upon a rotation angle of the second adjustable rotation joint; and outputting, at a second end of the amplitude and phase trimmer device, the fourth electromagnetic signal.

17. The method of claim 16, wherein the second end of the amplitude and phase trimmer device comprises an output section of the amplitude and phase trimmer device, the output section being connected to the second phase-shifting section, the method further comprising transitioning, by a coaxial adapter of the amplitude and phase trimmer device, the fourth electromagnetic signal from a rectangular waveguide to a coaxial cable, wherein the coaxial adapter is connected to the output section.

18. The method of claim 16, wherein the attenuation value, in decibels, is equal to ten times a log of a cosine squared of the rotation angle of the first adjustable rotation joint.

19. The method of claim 16, wherein the phase difference is equal to the rotation angle of the second adjustable rotation joint.

20. The method of claim 16, wherein each of the first electromagnetic signal, the second electromagnetic signal, the third electromagnetic signal, and the fourth electromagnetic signal is within a Ku band of microwave electromagnetic radiation.

* * * * *